US008457522B2

(12) United States Patent
Watanabe

(10) Patent No.: US 8,457,522 B2
(45) Date of Patent: Jun. 4, 2013

(54) IMAGE-HOLDING MEMBER CASES, DEVELOPING DEVICE CASES, AND IMAGE-FORMING APPARATUS

(75) Inventor: Kaoru Watanabe, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 325 days.

(21) Appl. No.: 12/908,523

(22) Filed: Oct. 20, 2010

(65) Prior Publication Data

US 2011/0217070 A1 Sep. 8, 2011

(30) Foreign Application Priority Data

Mar. 2, 2010 (JP) ..... 2010-045284

(51) Int. Cl.
*G03G 21/16* (2006.01)
*G03G 15/02* (2006.01)
*G03G 15/00* (2006.01)

(52) U.S. Cl.
USPC ..... 399/111; 399/116; 399/159

(58) Field of Classification Search
USPC ..... 399/111, 113, 116, 117, 159
See application file for complete search history.

(56) References Cited

U.S. PATENT DOCUMENTS 7,020,416 B2 * 3/2006 Kato et al. ..... 399/110

FOREIGN PATENT DOCUMENTS

JP 2005-300849 A 10/2005

* cited by examiner

*Primary Examiner* — Joseph S Wong
(74) *Attorney, Agent, or Firm* — Sughrue Mion, PLLC

(57) ABSTRACT

An image-forming apparatus includes: an image-holding member casing that encases an image-holding member; an apparatus main body into which the image-holding member casing is inserted to a predetermined position; a developing device casing provided in the apparatus main body, the developing device casing encasing a developing device; a pushing member provided in the apparatus main body to push the developing device casing in a first direction toward the image-holding member; and a contact portion provided on the image-holding member casing so as to contact the developing device casing for a predetermined period during insertion of the image-holding member casing toward the predetermined position, to push the developing device casing in a second direction opposite to the first direction, wherein, after the predetermined period, when the image-holding member casing reaches the predetermined position, the contact portion does not push the developing device casing in the second direction.

10 Claims, 10 Drawing Sheets

IMAGE-HOLDING MEMBER CASES, DEVELOPING DEVICE CASES, AND IMAGE-FORMING APPARATUS

CROSS-REFERENCE TO RELATED APPLICATIONS

This application is based on and claims priority under 35 U.S.C. 119 from Japanese Patent Application No. 2010-45284, which was filed on Mar. 2, 2010.

BACKGROUND

1. Technical Field

The present invention relates to an image-forming apparatus.

2. Related Art

In some image-forming apparatuses of an electrophotography type, a casing that encases an image-holding member for holding an electrostatic latent image is removably installed in an apparatus main body that contains a developing device for supplying developer to the image-holding member. In such an image-forming apparatus, when a user inserts the casing to a predetermined position in the apparatus main body, the image-holding member and the developing device are brought into a proper positional relationship relative to each other, so that forming of an image can be carried out. In such an image-forming apparatus, it is necessary to protect externally exposed parts when the casing is inserted into or removed from the image-forming apparatus.

SUMMARY

In one aspect of the present invention, there is provided an image-forming apparatus including: an image-holding member casing that encases an image-holding member for holding an image, such that the image-holding member is partially exposed; an apparatus main body into which the image-holding member casing is inserted to a predetermined position; a developing device casing provided in the apparatus main body, the developing device casing encasing a developing device, such that the developing device is partially exposed, the developing device supplying developer to the image-holding member encased in the image-holding member casing inserted to the predetermined position; a pushing member provided in the apparatus main body to push the developing device casing in a first direction toward the image-holding member; and a contact portion provided on the image-holding member casing so as to contact the developing device casing for a predetermined period during insertion of the image-holding member casing toward the predetermined position in the apparatus main body, to push the developing device casing in a second direction opposite to the first direction, wherein, after the predetermined period, when the image-holding member casing reaches the predetermined position, the contact portion does not push the developing device casing in the second direction.

BRIEF DESCRIPTION OF THE DRAWINGS

Exemplary embodiments of the present invention will now be described in detail with reference to the following figures, wherein.

DETAILED DESCRIPTION

1. Configuration of Exemplary Embodiment

Figure 1:
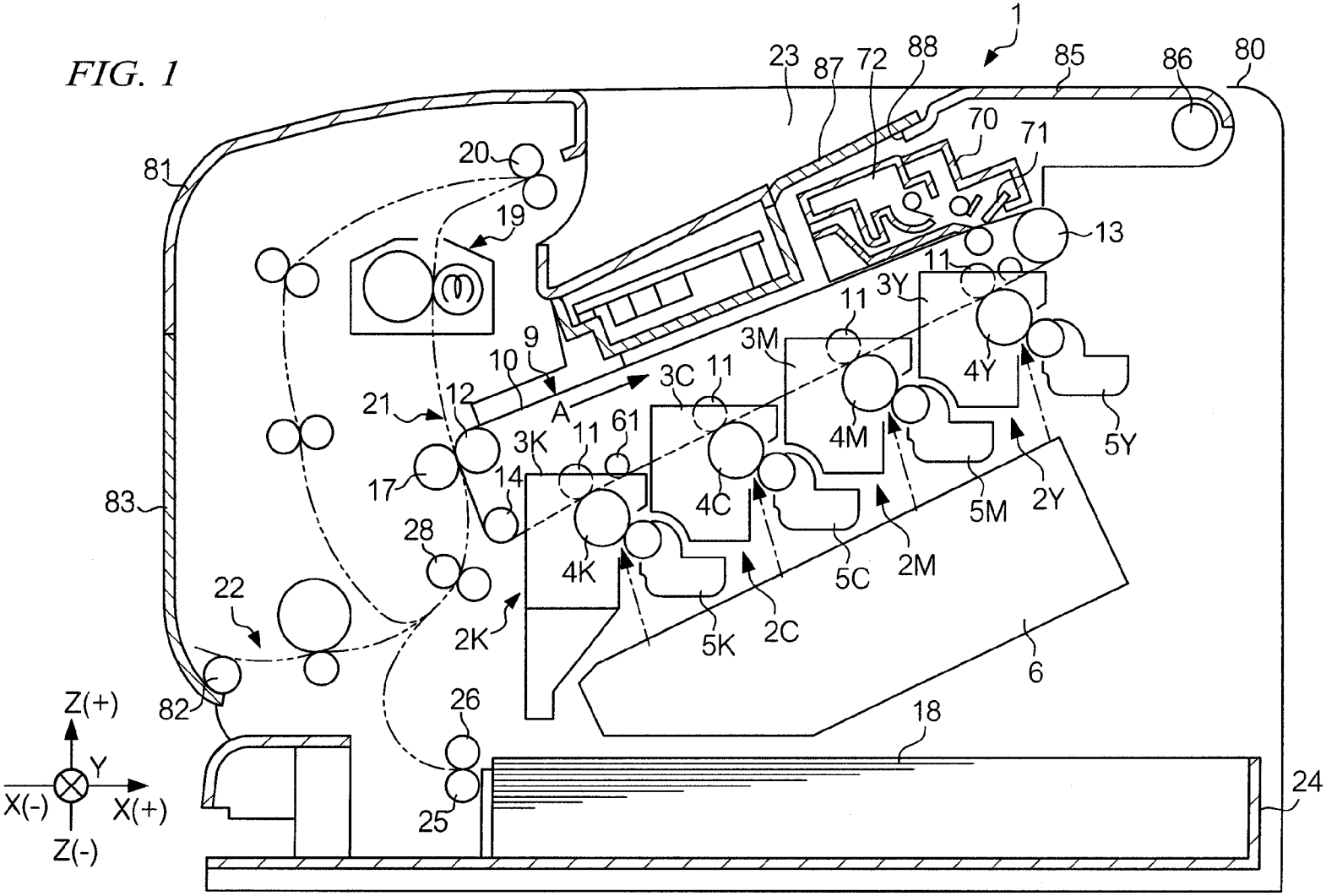
FIG. 1 schematically shows a configuration of an image-forming apparatus according to an exemplary embodiment of the present invention.

FIG. 1 schematically shows a configuration of image-forming apparatus 1 according to an exemplary embodiment of the present invention. In the following, description is given of image-forming apparatus 1 as viewed from the front of the apparatus, where the horizontal direction is denoted as the X-axis direction, with right/left directions from a viewer's perspective being indicated by X(+) and X(−), respectively; the front-back direction of image-forming apparatus 1 is denoted as the Y-axis direction, with back/front directions of image-forming apparatus 1 being indicated by Y(+) and Y(−), respectively; and the vertical direction is denoted as the Z-axis direction, with up/down directions being indicated by Z(+) and Z(−), respectively.

(1) Configuration of Image-Forming Apparatus

Image-forming apparatus 1 is a color printer, in which image-forming units are arranged in a line along an intermediate transfer belt. Image-forming apparatus 1 contains an image-processing unit (not shown) that performs image processing on image data received from a device such as a scanner or a personal computer (not shown), or received via a communication line (not shown), etc. Further, inside image-forming apparatus 1 there are provided four image-forming units 2Y, 2M, 2C, 2K for yellow (Y), magenta (M), cyan (C), and black (K), respectively.

Each of the four image-forming units 2Y, 2M, 2C, 2K has basically the same structure, and thus, in the following description, where it is not necessary to distinguish between image-forming units 2Y, 2M, 2C, 2K, the image-forming units will simply be referred to as image-forming unit(s) 2.

Each image-forming unit 2 has photosensitive member unit 3 and developer unit 5. Photosensitive member unit 3 includes photosensitive drum 4, which serves as an image-holding member, and a charging device. Photosensitive member unit 3 is removably installed in apparatus main body 80. Developer unit 5 is secured to apparatus main body 80 via a frame (not shown).

Below image-forming units 2Y, 2M, 2C, 2K, image exposure unit 6, which is common to image-forming units 2Y, 2M, 2C, 2K, is provided. Image exposure unit 6 has four semiconductor laser units (not shown) for emitting laser beams modulated in accordance with image data of respective colors (Y, M, C, K). The four laser beams emitted from these semiconductor laser units are deflected by a polygon mirror and, via optical elements such as a lens and a mirror (not shown), are scanned over a surface of photosensitive drum 4 of corresponding image-forming unit 2Y, 2M, 2C, 2K to form an electrostatic latent image. The electrostatic latent images formed on photosensitive drums 4 are developed by developer units 5Y, 5M, 5C, 5K using developers each including respective color toner, to form toner images of respective colors. The toner images of respective colors formed sequentially on photosensitive drums 4 of image-forming units 2Y, 2M, 2C, 2K are transferred one on top of another by primary transfer rollers 11 to an outer surface (or an underside surface) of intermediate transfer belt 10, which is arranged over the top of each of image-forming units 2Y, 2M, 2C, 2K, and serves as an intermediate transfer member.

Intermediate transfer belt 10 is an endless belt-shaped member tension-supported by multiple rollers, such as drive roller 12, tension roller 13, and idler roller 14, such that intermediate transfer belt 10 circulates in a direction indicated by arrow A under rotation of drive roller 12, which is rotated by a drive motor (not shown). Intermediate transfer belt 10 has an upper moving section and a lower moving section, and is arranged such that the lower moving section is in contact with photosensitive drums 4Y, 4M, 4C, 4K of image-forming units 2Y, 2M, 2C, 2K. As intermediate transfer belt 10, a flexible film made of a synthetic resin, such as polyimide, may be used, with ends of the synthetic resin film being joined by welding or the like so as to form an endless belt member.

It is to be noted that intermediate transfer belt 10, primary transfer rollers 11, drive roller 12, tension roller 13, idler roller 14, and others, constitute intermediate transfer unit 9.

Recording sheets 18, having a prescribed size and being made of a prescribed material, and serving as recording media, are contained in sheet container 24 disposed inside image-forming apparatus 1, and are conveyed from sheet container 24 along conveyance path 21 by multiple rollers. Recording sheets 18 are supplied from sheet container 24 one at a time by supply roller 25 and separation roller 26 for conveyance to registration rollers 28, where each sheet 18 is held temporarily. Registration rollers 28 are caused to rotate at a predetermined timing to further convey each recording sheet 18 to a secondary transfer position at intermediate transfer belt 10. At the secondary transfer position there is provided secondary transfer roller 17 on one side of intermediate transfer belt 10 and in opposing relation to drive roller 12 provided on the other side of intermediate transfer belt 10. Secondary transfer roller 17 is urged against intermediate transfer belt 10 to press each recording sheet 18 against intermediate transfer belt 10 as the sheet moves between secondary transfer roller 17 and intermediate transfer belt 10. Toner images of yellow (Y), magenta (M), cyan (C), and black (K) provided in overlapping relation on intermediate transfer belt 10 are transferred onto recording sheet 18 under pressure of secondary transfer roller 17 and action of electrostatic force. Fixing unit 19 applies heat and pressure to recording sheet 18 onto which toner images of respective colors have been transferred at the secondary transfer position, so as to fix the transferred images on recording sheet 18. Thereafter, recording sheet 18 is discharged by discharge roller 20 onto sheet-receiving tray 23, which is provided at an upper portion of image-forming apparatus 1. Conveyance path 21 also includes reversing mechanism 22 for reversing a front side and a back side of recording sheet 18.

(2) Configuration of Apparatus Main Body

Figure 2:
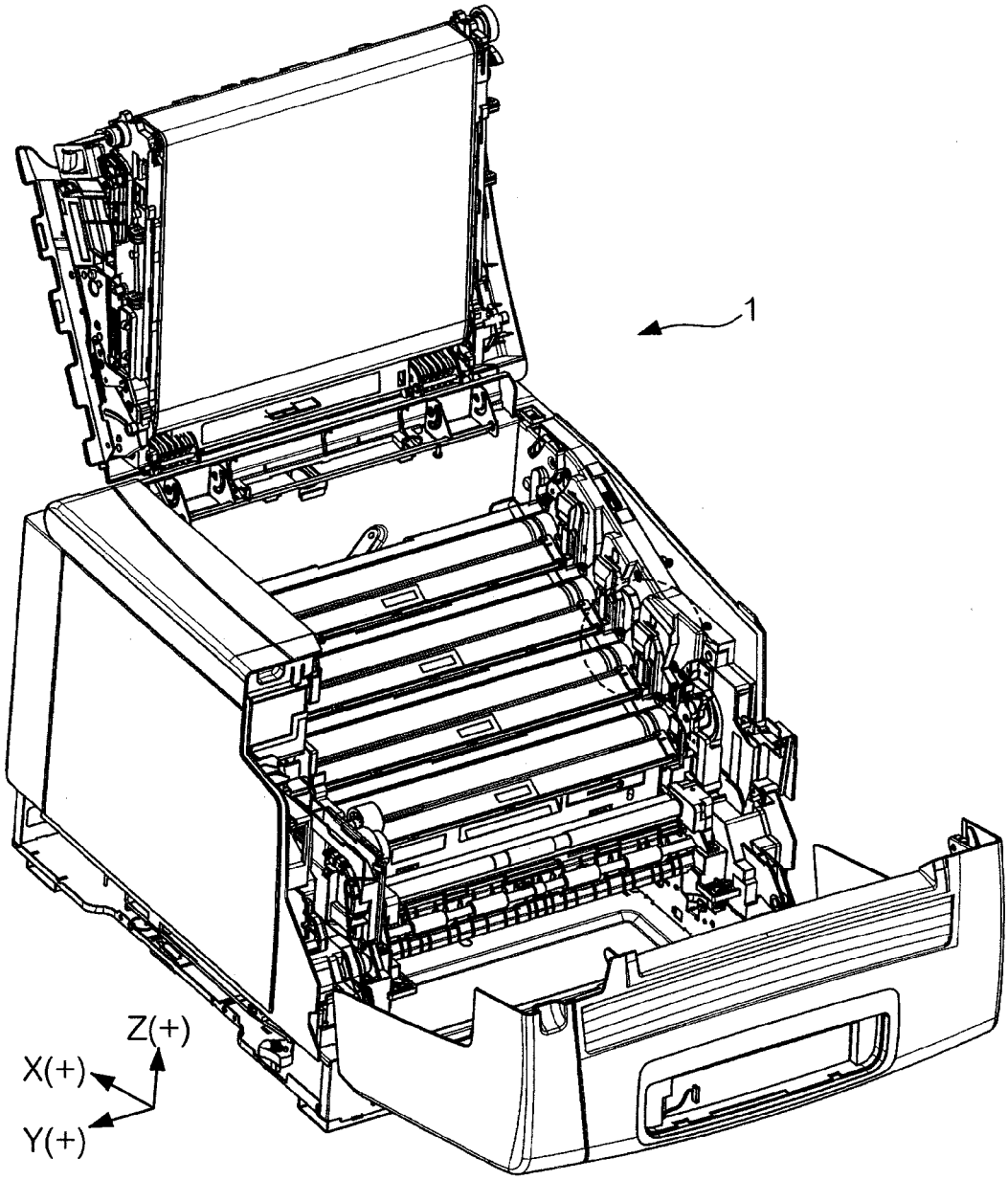
FIG. 2 is a perspective view showing an exterior of the image-forming apparatus in a state where a lid member is opened.
Figure 3:
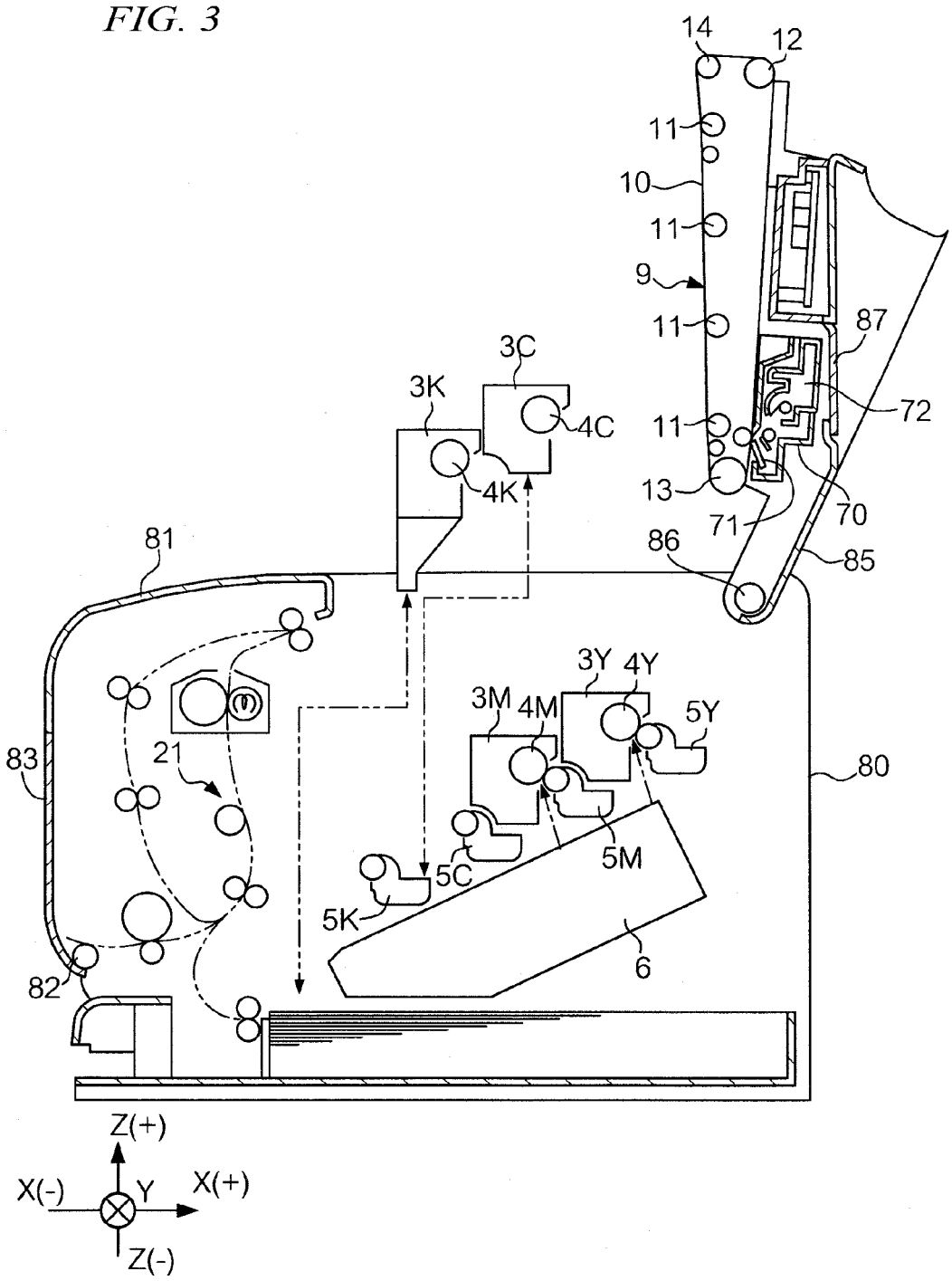
FIG. 3 is a diagram showing an interior of the image forming apparatus in a state where the lid member is opened.

In the following, further explanation will be given of a configuration of image-forming apparatus 1 with reference to FIGS. 2 and 3. FIG. 2 is a perspective view showing an exterior of image-forming apparatus 1 with a lid member in an open state, and FIG. 3 is a diagram showing an inner configuration of image-forming apparatus 1 with a lid member in an open state.

On a lateral side of main body 80 of image-forming apparatus 1 is attached side cover 81, which is pivotable about support shaft 82 for opening and closing. Side cover 81 in turn is provided with manual sheet feed tray 83, which can be opened and closed relative to side cover 81. Manual sheet feed tray 83 is usually closed relative to side cover 81; but when it is desired to use a recording sheet of a type different from that contained in sheet container 24, manual sheet feed tray 83 is opened relative to side cover 81 so as to enable a desired recording sheet to be supplied to conveyance path 21 through the open manual sheet feed tray 83.

On an upper side of apparatus main body 80 there is provided lid member 85, which can pivot about support shaft 86 to be opened and closed. An upper surface of lid member 85 serves as sheet discharge tray 23, onto which recording sheets 18 having a toner image formed thereon are discharged. Further, operating unit (not shown) is provided on the upper side of apparatus main body 80. For example, the operating unit includes a ten-key pad for entering a number of recording sheets, and the like.

Generally, lid member 85 is kept closed relative to apparatus main body 80, and is opened when photosensitive member units 3Y, 3M, 3C, 3K are installed in or removed from apparatus main body 80. Attached to this lid member 85 is sub-lid member 87, which can be opened and closed relative to lid member 85. Sub-lid member 87 is opened when a whole or a part of toner-collecting unit 70 is installed in or removed from apparatus main body 80. Toner-collecting unit 70 includes cleaning member 71 that contacts a surface of intermediate transfer belt 10 to remove toner attached on the surface, and collection chamber 72 in which the removed toner is collected.

(3) Configuration of Photosensitive Member Unit

Figure 4:
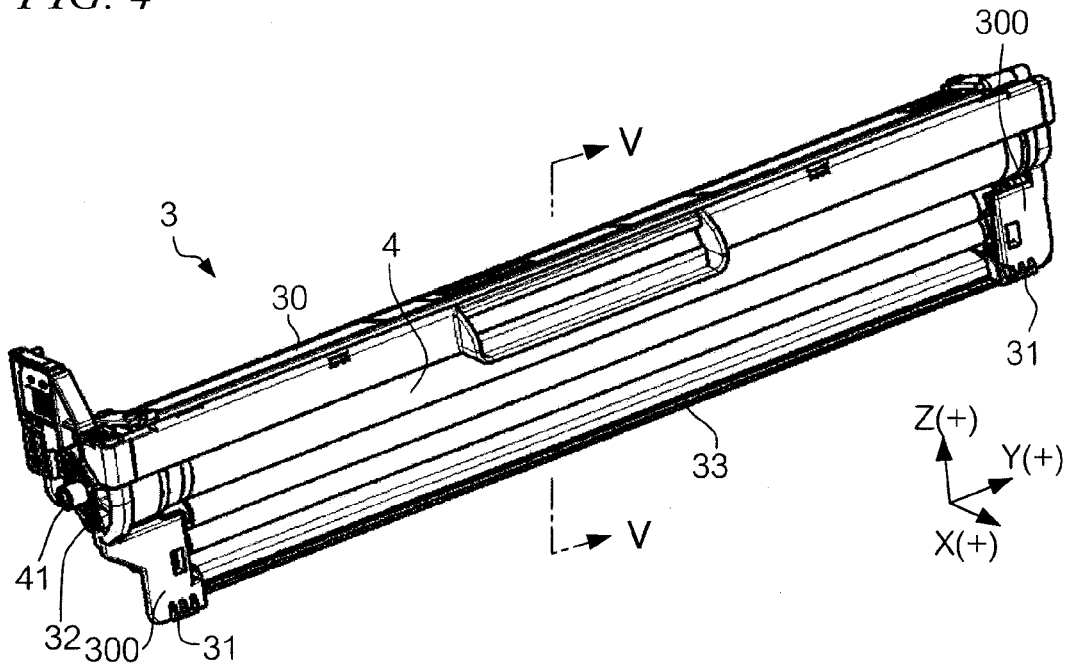
FIG. 4 is a perspective view showing a photosensitive member unit.

FIG. 4 is a perspective view showing photosensitive member unit 3. Photosensitive member unit 3 has photosensitive drum 4 and drum casing 30 for encasing photosensitive drum 4 such that photosensitive drum 4 is partially exposed. Thus, drum casing 30 is an example of an image-holding member casing that encases an image-holding member for holding an image, such that the image-holding member is partially exposed. Specifically, each end of shaft 41 of photosensitive drum 4 is received by corresponding bearing 32 of drum casing 30, whereby photosensitive drum 4 is encased in drum casing 30. In the following description, it is assumed that a direction of extension of shaft 41 is parallel to the Y-axis. Shaft 41 has a greater length in the Y-axis direction than drum casing 30, so that the ends of shaft 41 protrude from the bearings on Y(+) and Y(−) sides. Each end portion of shaft 41 is sandwiched by guide members (not shown) provided to apparatus main body 80, such that movement of photosensitive member unit 3 is prevented in the X-axis and Y-axis directions but is allowed in the Z-axis direction. Photosensitive member unit 3 is moved in the Z(−) direction to be inserted into apparatus main body 80. When drum casing 30 of photosensitive member unit 3 is inserted to a predetermined position in apparatus main body 80, drum casing 30 is fixed there so that image-forming apparatus 1 can perform image forming. In the following description, this position will be referred to as an image-forming position. Drum casing 30 inserted to the image-forming position can be removed from apparatus main body 80 by being moved in the Z(+) direction. Thus, apparatus main body 80 is an example of an apparatus main body into which an image-holding member casing is inserted to a predetermined position.

Figure 5:
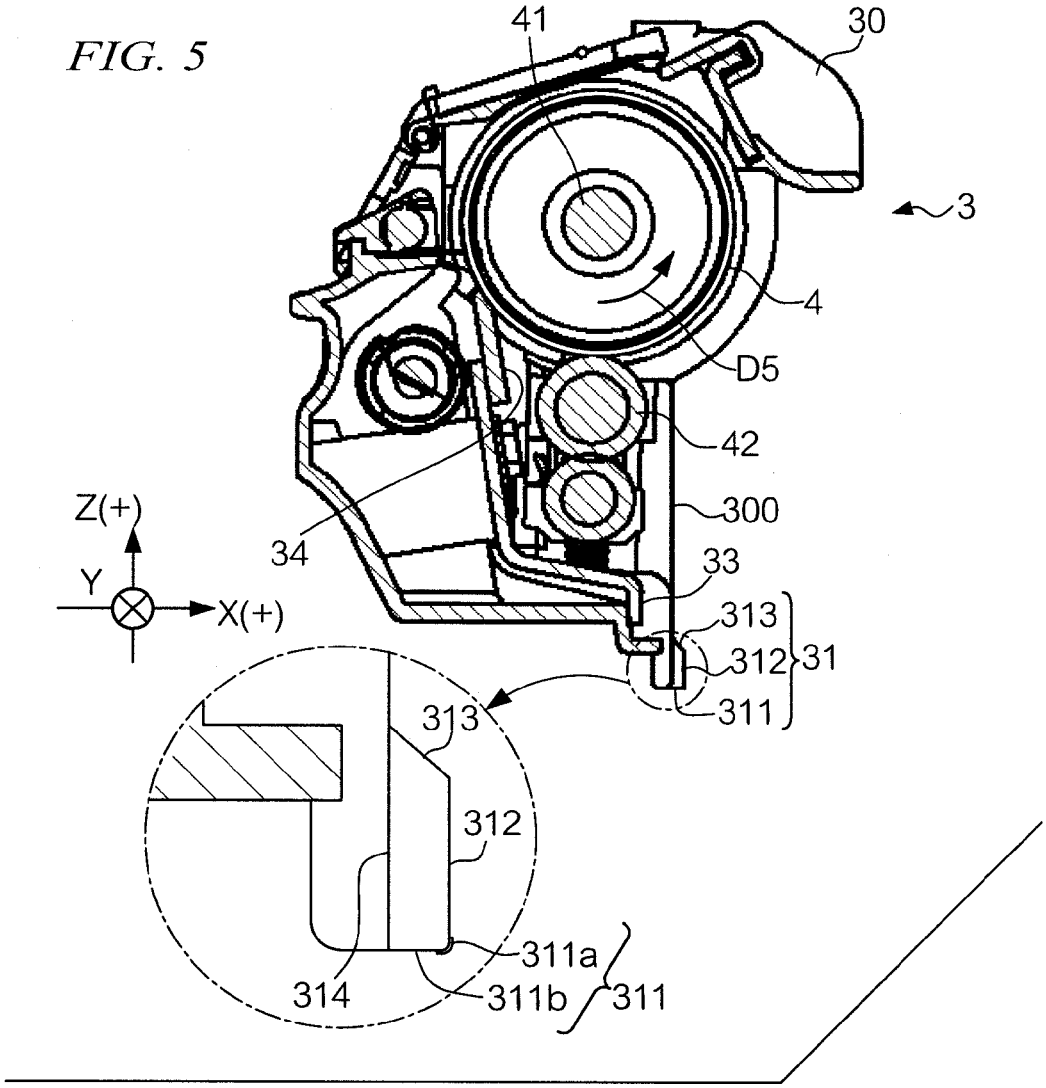
FIG. 5 is a cross-sectional view of the photosensitive member unit taken along line V-V in FIG. 4.

FIG. 5 is a cross-sectional view of photosensitive member unit 3 taken along line V-V in FIG. 4. Charging member 42 charges photosensitive drum 4, which is caused to rotate in a direction indicated by arrow D5. Blade 34 is brought into contact with a surface of photosensitive drum 4 to remove toner that was not transferred onto intermediate transfer belt 10 (see FIG. 1) and remained on the surface of photosensitive drum 4. Thus, blade 34 is an example of a cleaning member that cleans a surface of an image-holding member. Metallic plate 33 is a member that supports blade 34. Metallic plate 33 is made of iron, steel or the like, to have sufficient strength to support blade 34. Though iron and steel are strong, they are ferromagnetic and are prone to be attracted to a magnet or a material having magnetic attraction ability. Thus, metallic plate 33 is an example of a support member that supports a cleaning member and is made of a material prone to be attracted to a magnet. It is desired to minimize drum casing 30 of photosensitive member unit 3 to reduce an occupied space, and an end portion of metallic plate 33 opposite to an end portion that supports blade 34 is exposed in the X(+) direction without being covered by drum casing 30. Therefore, when drum casing 30 is inserted toward the image-forming position in apparatus main body 80 or when drum casing 30 is removed from apparatus main body 80, the exposed end portion of metallic plate 33 comes to face an exposed portion of development sleeve 50 (described later).

Contact portion 31 is provided on wall surface 300, which is provided in a lower (Z(−)) end portion of drum casing 30 and which, when related photosensitive member unit 3 is inserted into apparatus main body 80, is opposed to developer unit 5 corresponding to this photosensitive member unit 3. From a perspective of drum casing 30 that has been inserted to the image-forming position, developer unit 5 corresponding to related photosensitive member unit 3 is located in the X(+) direction, and thus, wall surface 300 has a normal vector extending in the X(+) direction. As shown in FIG. 5, contact portion 31 has lower end surface 311, side surface 312, and upper end surface 313, and protrudes in a direction from drum casing 30 toward developer unit 5 (the X(+) direction). Lower end surface 311 has curved surface 311*a* at a position close to side surface 312 and flat surface 311*b* at a position apart from side surface 312. This curved surface 311*a* has a normal vector extending in a direction having an X(+) directional component and a Z(−) directional component. Flat surface 311*b* has a normal vector extending in the Z(−) direction. Side surface 312 has a normal vector extending in the X(+) direction. As shown in FIG. 5, upper end surface 313 is inclined relative to the Z(+) direction. Specifically, upper end surface 313 has a normal vector extending in a direction having a Z(+) directional component and an X(+) directional component, where the Z(+) directional component is an example of a first directional component in a direction of removal of the image-holding member casing or a third directional component in a direction opposite to a direction of insertion of the image-holding member casing toward the image-forming position in the apparatus main body, and the X(+) directional component is an example of a second (or fourth) directional component in a direction from the image-holding member casing toward the developing device casing in a state where the image-holding member casing has been inserted to the image-forming position.

As shown in FIGS. 4 and 5, lower end surface 311, side surface 312, and upper end surface 313 of contact portion 31 on each longitudinal end portion of drum casing 30 are provided by three ribs attached on wall surface 300. A surface of contact portion 31 at the boundary with wall surface 300 is referred to as boundary surface 314. Boundary surface 314 is a part of contact portion 31 on a side of drum casing 30. Side surface 312 is located apart from wall surface 300 in the X(+) direction, and thus, is a part of contact portion 31 on a side of developer unit 5. Curved surface 311*a* is positioned closer to side surface 312 than to boundary surface 314 and, as will be described later, is a part of contact portion 31 that contacts sleeve casing 55 of developer unit 5 first when drum casing 30 is inserted to the image-forming position of apparatus main body 80. Curved surface 311*a* is an example of a part that is positioned closer to a part of the contact portion on a side of the developing device casing than to a part of the contact portion on a side of the image-forming member casing.

(4) Configuration of Developer Unit

Figure 6:
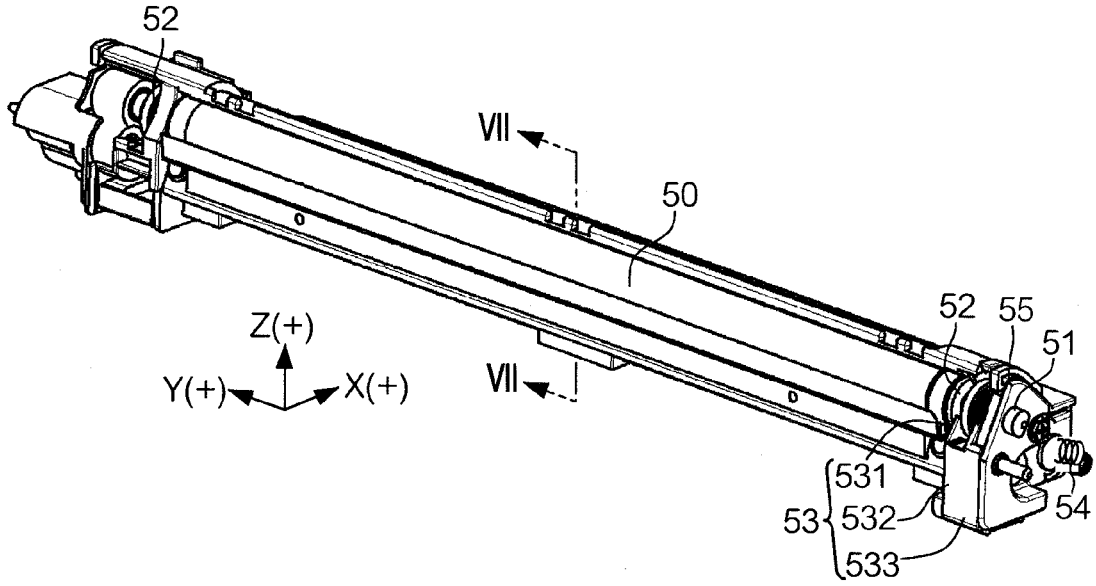
FIG. 6 is a perspective view showing a developer unit.

FIG. 6 is a perspective view of developer unit 5. Developer unit 5 includes developing sleeve 50 and sleeve casing 55 for encasing developing sleeve 50. Specifically, each end of shaft 51 of developing sleeve 50 is received by a corresponding bearing of sleeve casing 55, whereby developing sleeve 50 is encased in sleeve casing 55 such that developing sleeve 50 is partially exposed. In the following description, it is assumed that a direction of extension of shaft 51 is parallel to the Y-axis. Developing sleeve 50 is provided on an outer circumference of a magnet roll (not shown) so as to be rotatable about shaft 51, whereby magnetic attraction force of the magnet roll causes developer to be attracted onto a surface of developing sleeve 50. Developing sleeve 50 applies toner contained in the developer onto a region of the surface of photosensitive drum 4 where an electrostatic latent image is formed, thereby to perform development. The combination of the magnet roll and developing sleeve 50 is an example of a developing device that supplies developer to an image-holding member (photosensitive drum 4) encased in an image-holding member casing (drum casing 30) inserted to the image-forming position. The developing device, which may include a magnet roll, can have magnetic attraction ability.

Figure 7:
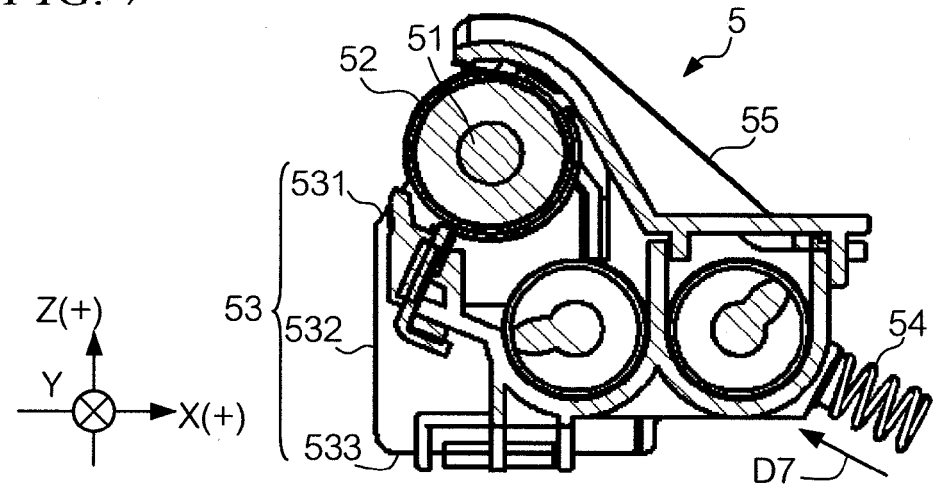
FIG. 7 is a cross-sectional view of the developer unit taken along line VII-VII in FIG. 6.

FIG. 7 is a cross-sectional view of developer unit 5 taken along line VII-VII in FIG. 6. Pushing member 54, which may be constituted of a spring or the like, pushes developer unit 5 in a direction indicated by arrow D7. Shaft 51 of developer unit 5 has a greater length in the Y-axis direction than sleeve casing 55, so that the ends of shaft 51 protrude from the bearings on Y(+) and Y(−) sides. Each end portion of shaft 51 is sandwiched by guide members (not shown) provided to apparatus main body 80, such that movement of developer unit 5 is allowed only in a direction of arrow D7 and its opposite direction. Pushing member 54 is an example of a pushing member that pushes the developing device casing (sleeve casing 55) in a first direction toward the image-holding member (photosensitive drum 4), during insertion of the image-holding member casing (drum casing 30) into the apparatus main body.

Tracking rollers 52 are members provided at respective end portions of developing sleeve in a longitudinal direction, so as to be rotatable about shaft 51 of developing sleeve 50. Since developer unit 5 is pushed by pushing member 54 in the direction of arrow D7, once photosensitive member unit 3 has been inserted into apparatus main body 80 and fixed at the image-forming position, tracking rollers 52 are brought into tight contact with photosensitive drum 4 and rotate along with rotation of photosensitive drum 4. A radius of each tracking roller 52 is larger than that of developing sleeve 50, and a distance from a surface of photosensitive drum 4 to a surface of developing sleeve 50 is equal to a difference between these radii. Thus, tracking roller 52 is an example of a distance-maintaining member that rotates about a shaft of the developing device while being in contact with the image-holding member to maintain a distance between the developing device and the image-holding member.

Protection wall 53 is a wall-shaped member provided on a side of sleeve casing 55 facing photosensitive member unit 3 corresponding to related developer unit 5 (i.e., on a side facing in the X(−) direction). Protection wall 53 serves to protect a developer supply container, a developer-regulating member, and others, which are disposed inside developer unit 5. Protection wall 53 has three surfaces: upper wall surface 531, side wall surface 532, and lower wall surface 533. Upper wall surface 531 is inclined relative to the Z(−) direction, as shown in FIG. 7. Thus, upper wall surface 531 has a normal vector extending in a direction having a Z(+) directional component and an X(−) directional component. Side wall surface 532 is a flat surface having a normal vector extending in the X(−) direction. Lower wall surface 533 has a curved surface at a position close to side wall surface 532 and a flat surface at a position apart from side wall surface 532. This curved surface has a normal vector extending in a direction having an X(−) directional component and a Z(−) directional component, and the flat surface has a normal vector extending in the Z(−) direction.

2. Operation of the Exemplary Embodiment

Next, explanation will be given of an operation of image-forming apparatus 1 according to the exemplary embodiment. In the following, description will be given respectively of an operation when photosensitive member unit 3 is inserted into apparatus main body 80 and of an operation when photosensitive member unit 3 is removed from apparatus main body 80.

(1) Operation During Insertion of Photosensitive Member Unit

Figure 8:
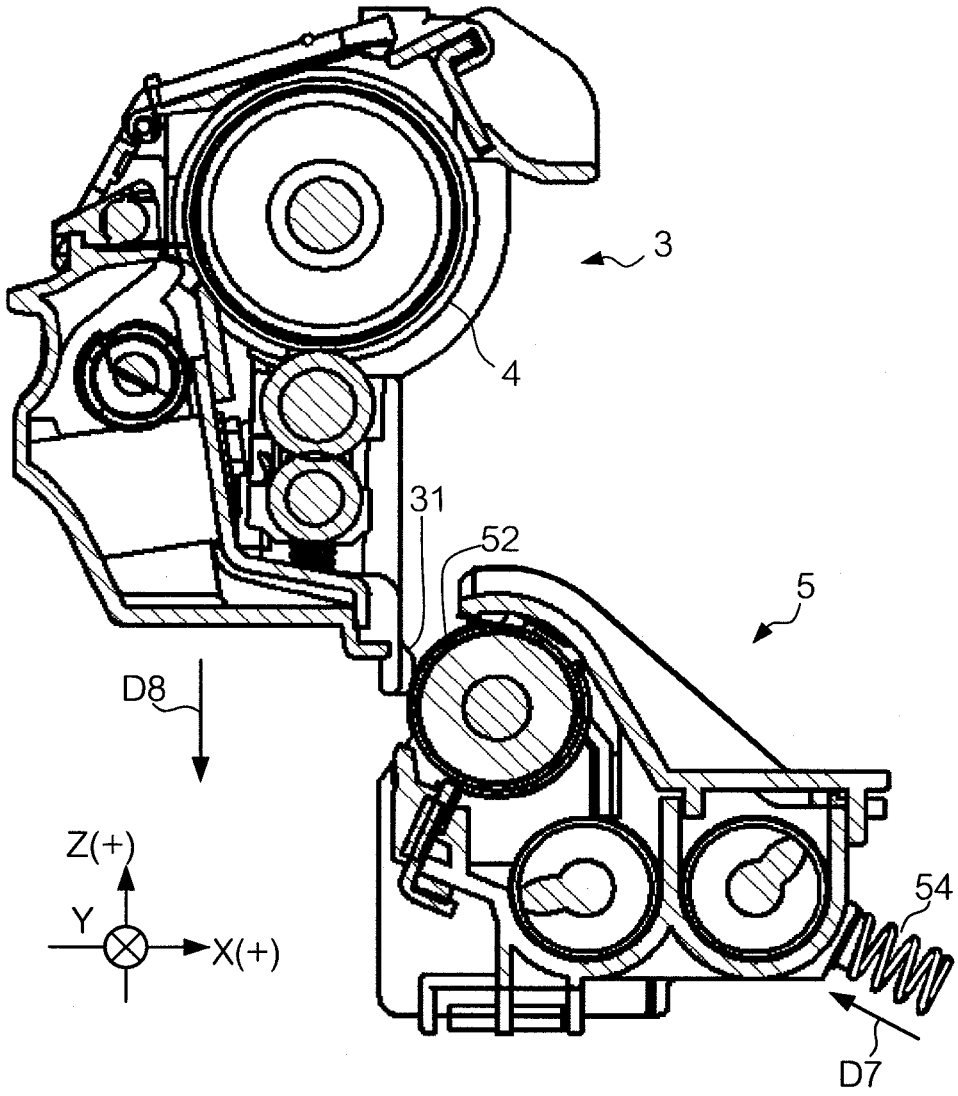
FIG. 8 shows the photosensitive member unit during insertion into an apparatus main body.

FIG. 8 is a diagram showing photosensitive member unit 3 being inserted into apparatus main body 80. Photosensitive member unit 3 is inserted into apparatus main body 80 by a user in a direction indicated by arrow D8. Since developer unit 5 is pushed by pushing member 54 in a direction of arrow D7, developer unit 5 is located on a path of insertion of photosensitive member unit 3. A part of photosensitive member unit 3 that contacts developer unit 5 first when photosensitive member unit 3 is inserted into apparatus main body 80 is curved surface 311*a* of lower end surface 311 of contact portion 31. Specifically, curved surface 311*a* contacts tracking roller 52 of developer unit 5.

Figure 9:
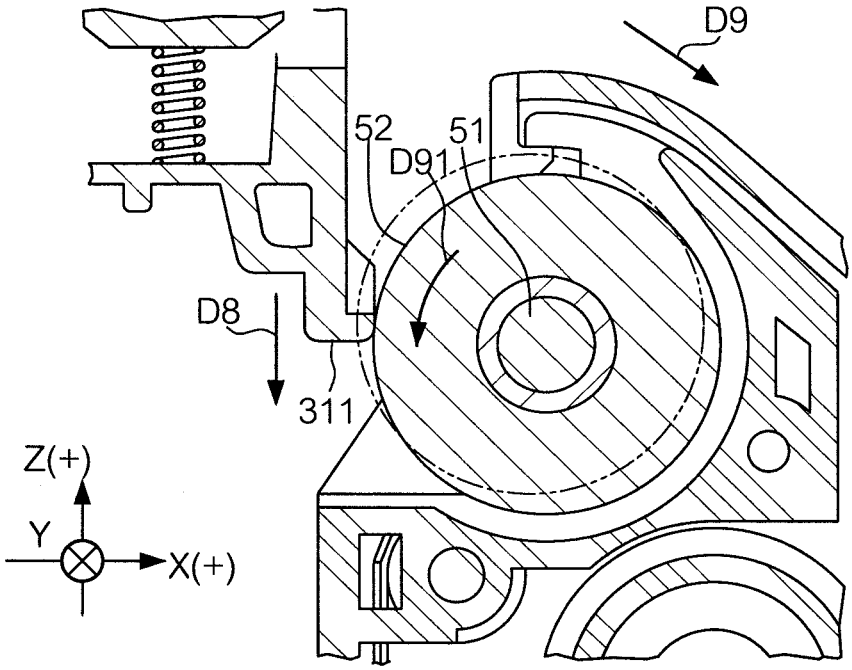
FIG. 9 is a diagram showing a state where a contact portion is in contact with a tracking roller.

FIG. 9 is a diagram showing a state where contact portion 31 is in contact with tracking roller 52. As photosensitive member unit 3 is moved in the direction of arrow D8 into apparatus main body 80, curved surface 311*a* of lower end surface 311 of contact portion 31 pushes tracking roller 52. Since the direction of movement of developer unit 5 is limited by guide members (not shown), developer unit 5 is caused to move in a direction indicated by arrow D9, which is opposite to the direction of arrow D7. In other words, developer unit 5 is caused to move in a direction opposite to the direction in which developer unit 5 is pushed by pushing member 54 (the direction of arrow D9 will be referred to as a "retracted direction" hereinafter). Along with the movement of developer unit 5, tracking roller 52 moves from a position indicated by a long- and double-short dashed line in FIG. 9, and rotates about shaft 51 in a direction indicated by arrow D91. Thus, contact portion 31 is an example of a contact portion that contacts a distance-maintaining member to push the developing device casing. When photosensitive member unit 3 is further inserted into apparatus main body 80, contact portion 31 is moved to be apart from tracking roller 52 and comes into contact with protection wall 53.

It is to be noted that curved surface 311*a* of lower end surface 311, which contacts tracking roller 52 in an early stage of insertion of photosensitive member unit 3, is located closer to a part of contact portion 31 on a side of developer unit 5 (for instance, side surface 312) than to a part of contact portion 31 on a side of drum casing 30 (for instance, boundary surface 314). Owing to such a structure, upon insertion of photosensitive member unit 3, curved surface 311*a* of contact portion 31 soon comes into contact with tracking roller 52 to start pushing developer unit 5 in the retracting direction. In other words, retraction of developer unit 5 in relation to insertion of photosensitive member unit 3 can start without undue delay. Also, the above-described arrangement of curved surface 311*a* contributes to minimizing a length of photosensitive member unit 3 in the Z-axis direction.

Figure 10:
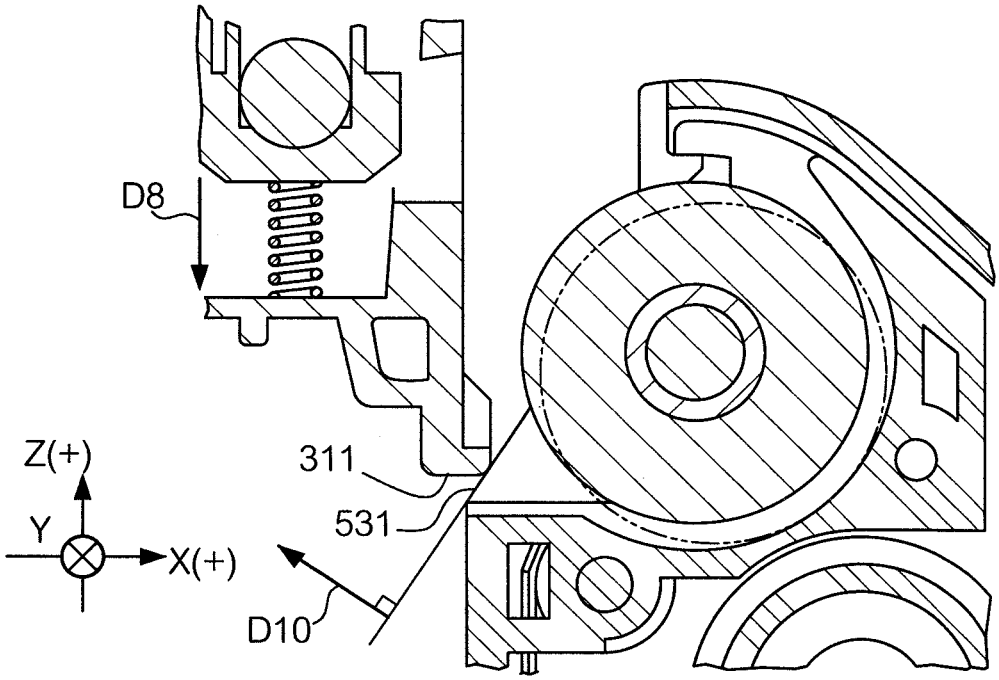
FIG. 10 is a diagram showing a state where the contact portion is in contact with a protection wall.

FIG. 10 is a diagram showing a state where contact portion 31 is in contact with protection wall 53. In this state, lower end surface 311 of contact portion 31 contacts upper wall surface 531 of protection wall 53. Upper wall surface 531 is inclined relative to the direction of arrow D8, which is the direction of insertion of photosensitive member unit 3, so that normal vector D10 of upper wall surface 531 has a directional component from developer unit 5 toward an insertion/removal path of photosensitive member unit 3 (i.e., X(−) component). During insertion of photosensitive unit 3, lower end surface 311 comes into contact with upper wall surface 531 and moves along the inclination of upper wall surface 531 toward side wall surface 532. Since the movement of lower end surface 311 (or photosensitive member unit 3) is prohibited in the X-axis and Y-axis directions, lower end surface 311 only moves in the Z(−) direction, and interaction between lower end surface 311 and inclined upper wall surface 531 pushes developer unit 5 in the direction of arrow D9 or in the retracting direction. As photosensitive member unit 3 is inserted further, contact portion 31 comes into contact with side wall surface 532.

Figure 11:
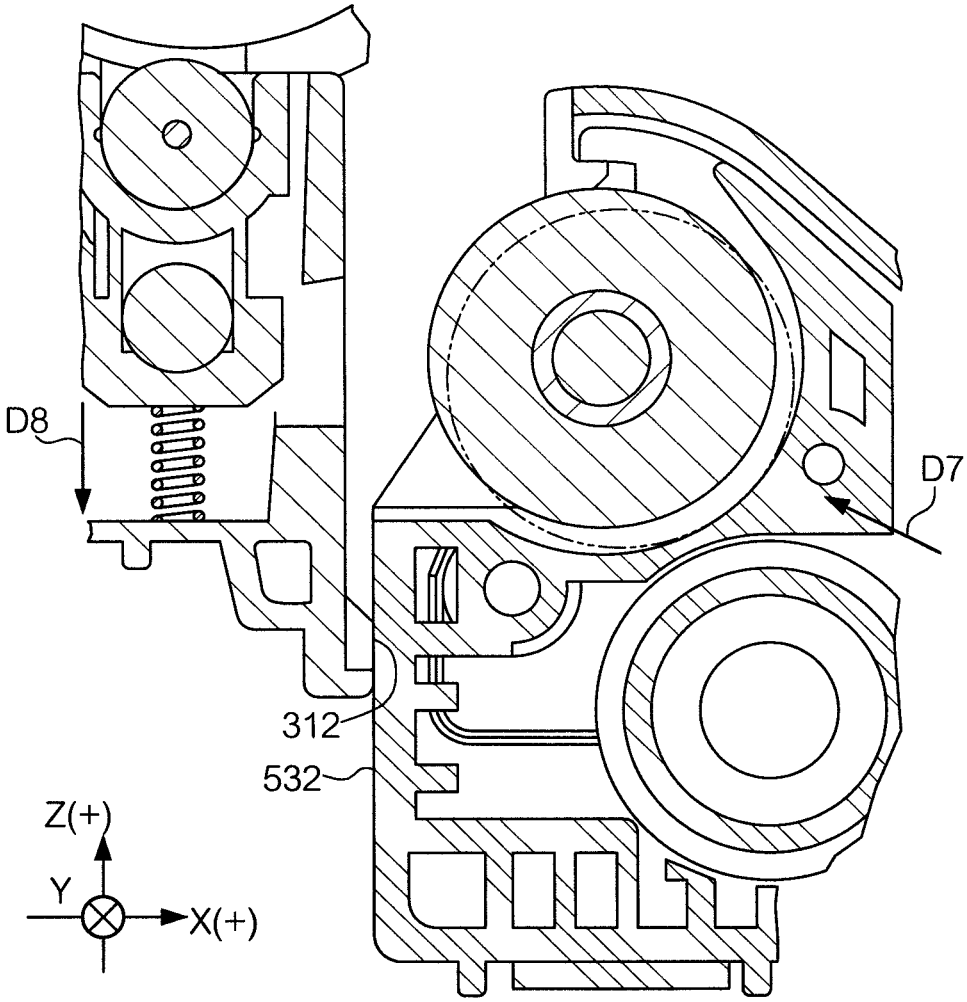
FIG. 11 is a diagram showing another state where the contact portion is in contact with the protection wall.

FIG. 11 is a diagram showing a state where contact portion 31 is in contact with side wall surface 532 of protection wall 53. As soon as lower end surface 311 of contact portion 31 separates from upper wall surface 531, side surface 312 of contact portion 31 comes into contact with side wall surface 532. As insertion of photosensitive member unit 3 proceeds, side surface 312 moves along side wall surface 532 toward lower wall surface 533 while being in contact with side wall surface 532. Since side wall surface 532 is parallel to the direction of arrow D8, during a period in which side surface 312 moves along side wall surface 532, developer unit 5 is stationary and pushing member 54 of developer unit 5 pushes photosensitive member unit 3 in the direction of arrow D7 via contact between side surface 312 and side wall surface 532. As photosensitive member unit 3 is inserted further, contact portion 31 separates from side wall surface 532, and comes into contact with lower wall surface 533. Specifically, upper end surface 313 of contact portion 311 comes into contact with lower wall surface 533, and this causes lower wall surface 533 to move along the inclination of upper end surface 313. Consequently, developer unit 5 moves gradually in the direction of arrow D7. Thereafter, contact portion 31 is moved further so as to be located apart from protection wall 53. Thus, upper end surface 313 is a surface that contacts the developing device casing last when the image-holding member casing is inserted toward a predetermined position (image-forming position) in the apparatus main body.

Figure 12:
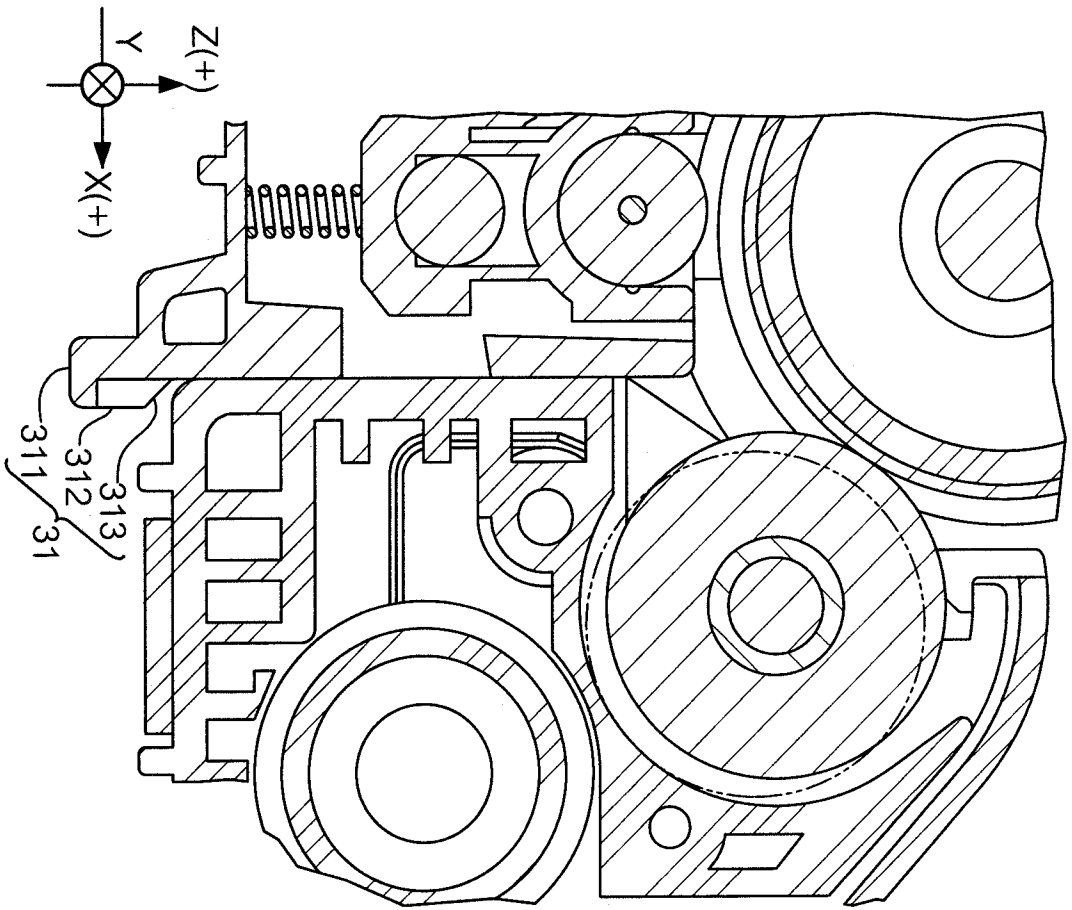
FIG. 12 is a diagram showing a state where the contact portion is located apart from the protection wall.

FIG. 12 is a diagram showing a state where contact portion 31 is located apart from protection wall 53. Following the movement of lower wall surface 533 along inclined upper end surface 313, when contact portion 31 is located below (Z(−) side) protection wall 53, contact portion 31 is no longer on a path of movement of protection wall 53 along the direction of arrow D7. In this state, side wall surface 532 of protection wall 53 contacts wall surface 300 of drum casing 30. Thus, pushing member 54 of developer unit 5 pushes photosensitive member unit 3 in the direction of arrow D7 via contact between side wall surface 532 and wall surface 300. As photosensitive member unit 3 is inserted further, wall surface 300 is moved along side wall surface 532 in the Z(−) direction while being in contact with side wall surface 532, and when tracking roller 52 comes into contact with photosensitive drum 4, photosensitive member unit 3 is held at this position (image-forming position). In this state, contact portion 31 is located apart from protection wall 53 and thus does not push developer unit 5 in the retracting direction. It is to be noted that in this exemplary embodiment, contact portion 31 has been moved to be apart from protection wall 53 by the time tracking roller 52 comes into contact with photosensitive drum 4, but contact portion 31 may be in contact with protection wall 53, so long as contact portion 31 does not exert a force pushing protection wall 53 in the retracting direction when tracking roller 52 is in contact with photosensitive drum 4. Also, contact portion 31 may be adapted to stop pushing developer unit 5 in the retracting direction at the same time when tracking roller 52 comes into contact with photosensitive drum 4. Thus, contact portion 31 is an example of a contact portion provided on the image-holding member casing so as to contact the developing device casing for a predetermined period during insertion of the image-holding member casing toward the predetermined position in the apparatus main body, to push the developing device casing in a second direction opposite to the first direction (or the direction in which the pushing member pushes the developing device casing), wherein, after the predetermined period, when the image-holding member casing reaches the predetermined position, the contact portion does not push the developing device casing in the second direction.

Figure 13:
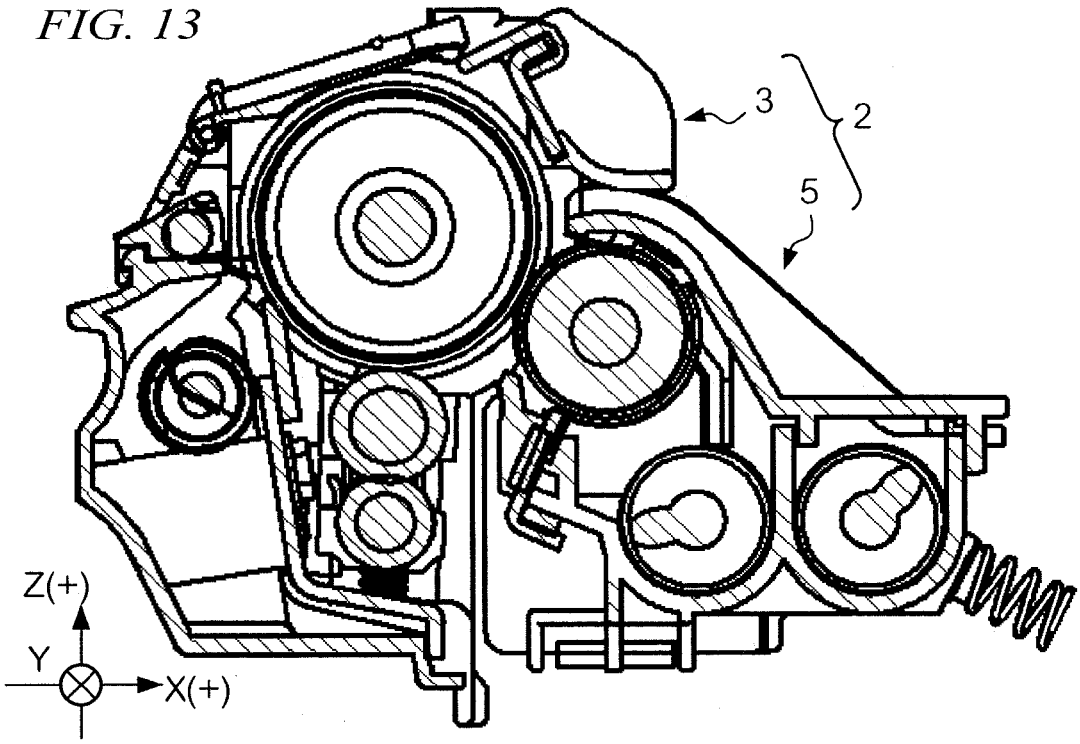
FIG. 13 is a diagram showing a drum casing placed at an image-forming position.

FIG. 13 is a diagram showing drum casing 30 set at the image-forming position. When drum casing 30 reaches the image-forming position, tracking roll 53 contacts photosensitive drum 4, whereby the distance between photosensitive drum 4 and developing sleeve 4 is maintained to be constant. In this state, toner is supplied from the surface of developing sleeve 50 to photosensitive drum 4, so that image-forming apparatus 1 can form an image on recording sheet 18.

(2) Operation for Removal of Photosensitive Member Unit

Figure 14:
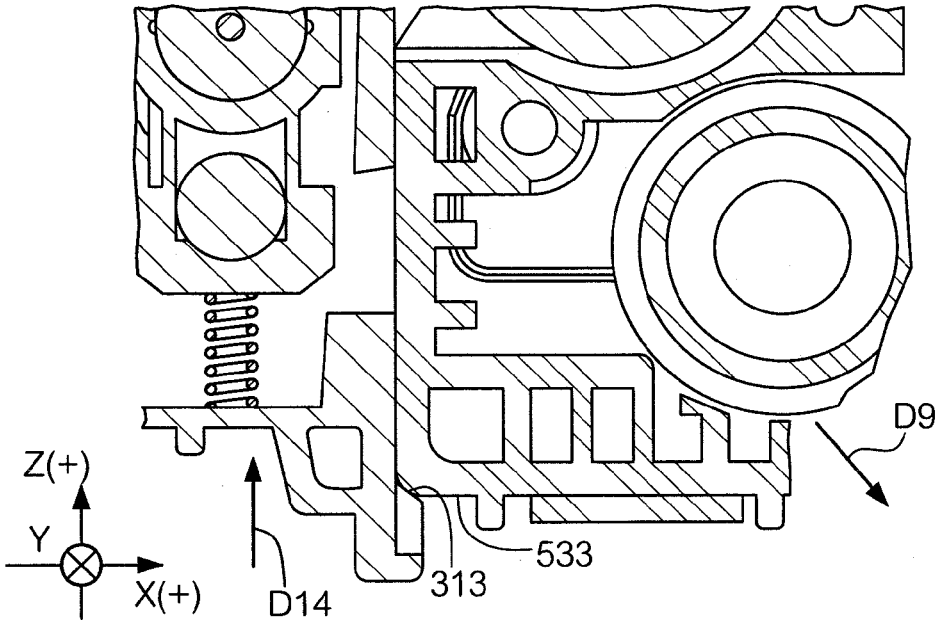
FIG. 14 is a diagram showing an operation of removing the photosensitive member unit from the apparatus main body.

FIG. 14 is a diagram showing an operation for removing photosensitive member unit 3 from apparatus main body 80. When drum casing 30 is at the image-forming position, side wall 300 is in contact with side wall surface 532 as shown in FIG. 13, and pushing member 54 pushes developer unit 5 in the direction of arrow D7 toward photosensitive member unit 3. From this state, when a user pulls out photosensitive member unit 3 from apparatus main body 80, photosensitive member unit 3 is moved in a direction indicated by arrow D14. As photosensitive member unit 3 is moved in the direction of arrow D14, upper end surface 313 of contact portion 31 comes into contact with lower wall surface 533 first. Thus, upper end surface 313 is an example of a surface that contacts the developing device casing first when the image-forming member casing is removed from the predetermined position in the apparatus main body. Since upper end surface 313 is inclined and photosensitive member unit 3 is prevented from moving in the X-axis and Y-axis directions by guide members (not shown), as photosensitive member unit 3 is moved in the direction of arrow D14, lower wall surface 533 is moved along the inclination of upper end surface 313 while being in contact with upper end surface 313, whereby developer unit 5 is moved in the retracting direction (in the direction of arrow D9).

It is to be noted that, contrary to when photosensitive member unit 3 is inserted into apparatus main body 80, a part of developer unit 5 that contact portion 31 contacts first when photosensitive member unit 3 is pulled out of apparatus main body 80 is not a rotating part such as tracking roller 52. Therefore, conversion of a force for pulling out photosensitive member unit 3 into a force for causing retraction of developer unit 5 may not be readily achieved. However, in image-forming apparatus 1, because upper end surface 313 is inclined as described in the foregoing, interaction between upper end surface 313 and lower wall surface 533 readily converts the force for pulling out photosensitive member unit 3 into the force for causing retraction of developer unit 5. This contributes to easy removal of photosensitive member unit 3 from apparatus main body 80.

As photosensitive member unit 3 is further moved upwardly (in the Z(+) direction), side surface 312 of contact portion 31 comes into contact with side wall surface 532 of protection wall 53, so that contact portion 31 moves along side wall surface 532. Thereafter, as photosensitive member unit 3 is further moved upwardly, contact portion 31 separates from protection wall 53 and tracking roller 52, and the removal of photosensitive member unit 3 from apparatus main body 80 is completed. In this state, contact portion 31 is apart from components of developer unit 5, such as protection wall 53 or tracking roller 52, and therefore, does not push developer unit 5. Thus, contact portion 31 is an example of a contact portion that contacts the developing device casing for a predetermined period during removal of the image-holding member casing from the predetermined position in the apparatus main body, to push the developing device casing in the second direction, and that stops pushing the developing device casing by the time removal of the image-holding member casing from the apparatus main body is completed.

As is described in the foregoing, in image-forming apparatus 1, when photosensitive member unit 3 is inserted into apparatus main body 80, contact portion 31 of photosensitive member unit 3 comes into contact with protection wall 53 of developer unit 5. Since contact portion 31 has a thickness in the X-axis direction and movement of photosensitive member unit 3 is prevented in the directions other than in the Z-axis direction, developer unit 5 is caused to move in the retracting direction for a certain period during the insertion of photosensitive member unit 3. Further, developer unit 5 is also caused to move in the retracting direction for a certain period during removal of photosensitive member unit 3 from apparatus main body 80. Thus, in image-forming apparatus 1, developer unit 5 is caused to retract in relation with an action of insertion/removal of photosensitive member unit 3, and it is not required to provide an extra mechanism for causing developer unit 5 to retract prior to insertion/removal of photosensitive member unit 3.

As is stated in the foregoing, metallic plate 33 requires high strength and thus is made of iron, steel or the like, which materials are prone to be attracted to a magnet, and an end portion of metallic plate 33 is exposed in the X(+) direction. Also, when drum casing 30 is inserted toward the image-forming position in apparatus main body 80 or is removed from apparatus main body 80, metallic plate 33 faces an exposed portion of developing sleeve 50. Because developing sleeve 50 has magnetic attraction ability due to the magnet roll, the end portion of metallic plate 33 tends to be magnetically attracted to developing sleeve 50 during insertion/removal of photosensitive member unit 3, and this can result in damage caused to developing sleeve 50 by the end of metallic plate 33, if contact portion 31 is absent. In image-forming apparatus 1, contact portion 31 is provided on wall surface 300, and developer unit 5 is caused to retract in relation with an action of insertion/removal of photosensitive member unit 3, whereby a risk that developing sleeve 50 can be damaged due to contact with the end portion of metallic plate 33 is reduced.

When photosensitive member unit 3 is inserted into apparatus main body 80 to such an extent that drum casing 30 reaches the image-forming position, developer unit 5 is moved back from the retracted position so as to be in close contact with photosensitive member unit 3. Therefore, it is not necessary, for example, to additionally provide a drive unit, such as an electric motor, that is activated in response to detection of a particular position of photosensitive member unit 3 to move developer unit 5 to a position where developer unit 5 is in close contact with photosensitive member unit 3.

It is also to be noted that if developer unit 5 is moved back abruptly from the retracted position to the position where developer unit 5 is in close contact with photosensitive member unit 3, developer unit 5 may be subject to an impact, which may cause damage to developer unit 5. Therefore, if contact portion 31 is absent, it is necessary to provide a structure for lowering the moving speed of developer unit 5 toward photosensitive member unit 3 when drum casing 30 reaches the image-forming position, or any other structure for reducing the impact. In image-forming apparatus 1, contact portion 31 has inclined upper end surface 313, and lower wall surface 533 moves along the inclination of upper end surface 313, whereby developer unit 5 is caused to move back from the retracted position gradually to the position where developer unit 5 is in close contact with photosensitive member unit 3. Therefore, in image-forming apparatus 1, there is a low possibility that an abrupt movement of developer unit 5 can cause damage to developer unit 5.

3. Modifications

The aforementioned exemplary embodiment may be modified as described below.

In the exemplary embodiment, lower end surface 311 of contact portion 31 includes curved surface 311*a* near side surface 312. However, lower end surface may be constituted only of flat surface 311*b* without including curved surface 311*a*. In this case, a part of contact portion 31 that contacts developer unit 5 first when photosensitive member unit 3 is inserted into apparatus main body 80 is a vertex (or corner) formed by lower end surface 311 and side surface 312, and this vertex is also located closer to a part of contact portion 31 on a side of developer unit 5 than to a part of contact portion 31 on a side of drum casing 30. Therefore, retraction of developer unit 5 due to insertion of photosensitive member unit 3 can start at an earlier timing and a length of photosensitive member unit 3 in the Z-axis direction can be made shorter, as compared to a case where the part of contact portion 31 that contacts developer unit 5 first when photosensitive member unit 3 is inserted into apparatus main body 80 is positioned closer to a part of contact portion 31 on a side of drum casing 30 than to a part of contact portion 31 on a side of developer unit 5.

Also, in the exemplary embodiment, lower wall surface 533 has a curved surface at a position close to side wall surface 532, but lower wall surface 533 may be constituted only of a flat surface having a normal vector extending in the Z(−) direction without including the curved surface.

It is to be noted, however, in a case where the curved surfaces are provided, a part of contact portion 31/developer unit 5 that contacts a corresponding curved surface is caused to move along the curved surface, whereby smooth insertion/removal of photosensitive member unit 3 relative to apparatus main body 80 can be achieved.

The part of developer unit 5 that contact portion 31 comes into contact with first when photosensitive member unit 3 is pulled out from apparatus main body 80 may include a rotating part. In such a configuration, rotation of the rotating part facilitates conversion of a force for pulling out photosensitive member unit 3 into a force for causing developer unit 5 to retract, and this contributes to easy removal of photosensitive member unit 3 from apparatus main body 80.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming apparatus comprising:

an image-holding member casing that encases an image-holding member for holding an image, such that the image-holding member is partially exposed;

an apparatus main body into which the image-holding member casing is inserted to a predetermined position;

a developing device casing provided in the apparatus main body, the developing device casing encasing a developing device, such that the developing device is partially exposed, the developing device supplying developer to the image-holding member encased in the image-holding member casing inserted to the predetermined position;

a pushing member provided in the apparatus main body to push the developing device casing in a first direction toward the image-holding member; and a contact portion provided on the image-holding member casing so as to contact the developing device casing for a predetermined period during insertion of the image-holding member casing toward the predetermined position in the apparatus main body, to push the developing device casing in a second direction opposite to the first direction, wherein, after the predetermined period, when the image-holding member casing reaches the predetermined position, the contact portion does not push the developing device casing in the second direction, wherein the developing device is rotatable about a shaft, the developing device casing is provided with a distance-maintaining member for maintaining a distance between the developing device and the image-holding member, the distance-maintaining member being rotatable about the shaft while being in contact with the image-holding member, and the contact portion contacts the distance-maintaining member to push the developing device casing when the image-holding member casing is inserted into the apparatus main body.

2. The image-forming apparatus according to claim 1, wherein the contact portion contacts the developing device casing for a predetermined period during removal of the image-holding member casing from the predetermined position in the apparatus main body, to push the developing device casing in the second direction, and stops pushing the developing device casing by the time removal of the image-holding member casing from the apparatus main body is completed, and a surface of the contact portion that contacts the developing device casing first when the image-holding member casing is removed from the predetermined position in the apparatus main body has a normal vector having a first directional component in a direction of removal of the image-holding member casing and a second directional component in a direction from the image-holding member casing at the predetermined position toward the developing device casing.

3. The image-forming apparatus according to claim 1, wherein the image-holding member casing includes:

a cleaning member that cleans a surface of the image-holding member; and a support member that supports a cleaning member and is made of a material prone to be attracted to a magnet, the developing device has magnetic attraction ability, and the support member is positioned to face an exposed portion of the developing device to be magnetically attracted to the developing device, when the image-holding member casing is inserted toward the predetermined position in the apparatus main body or when the image-holding member casing is removed from the predetermined position.

4. The image-forming apparatus according to claim 1, wherein a part of the contact portion that contacts the developing device casing first when the image-holding member casing is inserted toward the predetermined position in the apparatus main body is located closer to a part of the contact portion on a side of the developing device casing than to a part of the contact portion on a side of the image-forming member casing.

5. The image-forming apparatus according to claim 1, wherein a surface of the contact portion that contacts the developing device casing last when the image-holding member casing is inserted toward the predetermined position in the apparatus main body is an inclined surface that has a normal vector having a third directional component in a direction opposite to a direction of insertion of the image-holding member casing toward the predetermined position in the apparatus main body and a fourth directional component in a direction from the image-holding member casing toward the developing device casing in a state where the image-holding member casing has been inserted to the predetermined position.

6. An image-forming apparatus comprising:

an image-holding member casing that encases an image-holding member for holding an image, such that the image-holding member is partially exposed;

an apparatus main body into which the image-holding member casing is inserted to a predetermined position;

a developing device casing provided in the apparatus main body, the developing device casing encasing a developing device, such that the developing device is partially exposed, the developing device supplying developer to the image-holding member encased in the image-holding member casing inserted to the predetermined position;

a pushing member provided in the apparatus main body to push the developing device casing in a first direction toward the image-holding member; and a contact portion provided on the image-holding member casing so as to contact the developing device casing for a predetermined period during insertion of the image-holding member casing toward the predetermined position in the apparatus main body, the contact portion protruding in a direction from the image-holding member casing toward the developing device casing, wherein the developing device is rotatable about a shaft, the developing device casing is provided with a distance-maintaining member for maintaining a distance between the developing device and the image-holding member, the distance-maintaining member being rotatable about the shaft while being in contact with the image-holding member, and the contact portion contacts the distance-maintaining member to push the developing device casing when the image-holding member casing is inserted into the apparatus main body.

7. An image-forming apparatus comprising:

an image-holding member casing that encases an image-holding member for holding an image, such that the image-holding member is partially exposed;

an apparatus main body into which the image-holding member casing is inserted to a predetermined position;

a developing device casing provided in the apparatus main body, the developing device casing encasing a developing device, such that the developing device is partially exposed, the developing device supplying developer to the image-holding member encased in the image-holding member casing inserted to the predetermined position;

a pushing member provided in the apparatus main body to push the developing device casing in a first direction toward the image-holding member; and a contact portion provided on the image-holding member casing so as to contact the developing device casing for a predetermined period during insertion of the image-holding member casing toward the predetermined position in the apparatus main body, to push the developing device casing in a second direction opposite to the first direction, wherein, after the predetermined period, when the image-holding member casing reaches the predetermined position, the contact portion does not push the developing device casing in the second direction, wherein the image-holding member casing includes:

a cleaning member that cleans a surface of the image-holding member; and a support member that supports a cleaning member and is made of a material prone to be attracted to a magnet, the developing device has magnetic attraction ability, and the support member is positioned to face an exposed portion of the developing device to be magnetically attracted to the developing device, when the image-holding member casing is inserted toward the predetermined position in the apparatus main body or when the image-holding member casing is removed from the predetermined position.

8. The image-forming apparatus according to claim 7, wherein the contact portion contacts the developing device casing for a predetermined period during removal of the image-holding member casing from the predetermined position in the apparatus main body, to push the developing device casing in the second direction, and stops pushing the developing device casing by the time removal of the image-holding member casing from the apparatus main body is completed, and a surface of the contact portion that contacts the developing device casing first when the image-holding member casing is removed from the predetermined position in the apparatus main body has a normal vector having a first directional component in a direction of removal of the image-holding member casing and a second directional component in a direction from the image-holding member casing at the predetermined position toward the developing device casing.

9. The image-forming apparatus according to claim 7, wherein a part of the contact portion that contacts the developing device casing first when the image-holding member casing is inserted toward the predetermined position in the apparatus main body is located closer to a part of the contact portion on a side of the developing device casing than to a part of the contact portion on a side of the image-forming member casing.

10. The image-forming apparatus according to claim 7, wherein a surface of the contact portion that contacts the developing device casing last when the image-holding member casing is inserted toward the predetermined position in the apparatus main body is an inclined surface that has a normal vector having a third directional component in a direction opposite to a direction of insertion of the image-holding member casing toward the predetermined position in the apparatus main body and a fourth directional component in a direction from the image-holding member casing toward the developing device casing in a state where the image-holding member casing has been inserted to the predetermined position.

* * * * *